United States Patent [19]

Sano et al.

[11] Patent Number: 4,634,646

[45] Date of Patent: Jan. 6, 1987

[54] METHOD FOR THE FORMATION OF ELECTROPHOTOGRAPHIC IMAGES

[75] Inventors: Yumiko Sano, Ibaraki; Teruyo Morimoto, Kobe, both of Japan

[73] Assignee: Mita Industrial Co., Ltd., Osaka, Japan

[21] Appl. No.: 745,120

[22] Filed: Jun. 17, 1985

[30] Foreign Application Priority Data

Jun. 20, 1984 [JP] Japan ..... 59-126908

[51] Int. Cl.[4] ..... G03G 13/22

[52] U.S. Cl. ..... 430/31; 355/14 CH; 430/37

[58] Field of Search ..... 430/31, 37

[56] References Cited

U.S. PATENT DOCUMENTS

| | | | |
|---|---|---|---|
| 2,758,939 | 8/1956 | Sugarman | 430/55 |
| 2,924,519 | 2/1960 | Bertelsen | 430/31 |
| 2,940,847 | 6/1960 | Kaprialian | 430/31 X |
| 3,852,208 | 12/1974 | Nagashima et al. | 430/37 X |
| 3,982,938 | 9/1976 | Honjo | 430/83 |

*Primary Examiner*—John D. Welsh

*Attorney, Agent, or Firm*—Armstrong, Nikaido, Marmelstein & Kubovcik

[57] ABSTRACT

A method for the formation of images comprising: (1) feeding a photoconductive toner, having a particle diameter of on the average 6 μm or less, to a conductive substrate to form a toner layer of 1 to 8 layers on said conductive substrate, (2) uniformly charging said toner layer, and (3) exposing said toner layer to form an electrostatic latent image thereon corresponding to the original.

7 Claims, 12 Drawing Figures

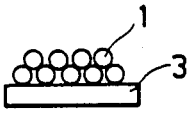
FIG. 2(a)
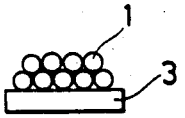
FIG. 2(b)
FIG. 3
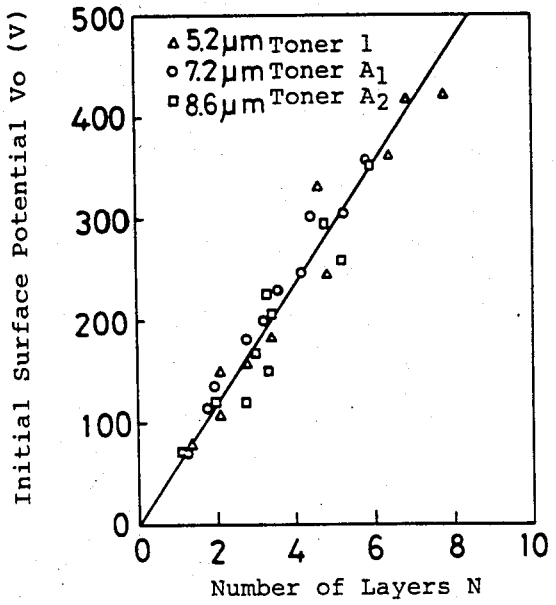

METHOD FOR THE FORMATION OF ELECTROPHOTOGRAPHIC IMAGES

BACKGROUND OF THE INVENTION

1. Field of the invention

This invention relates to a method for the formation of images, using a photoconductive toner.

2. Description of the prior art

A method using a photoconductive toner has been used for drawing lines in the production process of ships and for photo-electrophoresis. In recent years, an inky film made from photoconductive particles or toners has been proposed as a printer. It suggests that photoconductive toners can be used as a material for the formation of images.

A photoconductive toner used for the xerographic method, in which the photoconductive toner is coated on a substrate and then successively subjected to a charging step, an exposure step and an electrostatical transferring step, has insufficient capacity for holding electric charges thereon, so that the surface potential of the charged toner layer is remarkably low. Moreover, all of the electrical charges on the toner layer are not necessarily discharged in the exposure step, but a portion of them still remain as residual charges, so that the difference between the amount of charges in the exposed area and the nonexposed area on the toner layer must be small, resulting in an indistinct electrostatic latent image on the toner, which causes an indistinct final image on the transfer paper and also an increase in the fog density of the final image. In order to eliminate the residual charges and increase the initial surface potential to improve the distinction of the electrostatic latent image, improvements in the toner materials and system have been proposed. However, they cannot eliminate the above-mentioned drawbacks of the prior art because the fundamental characteristics (e.g., charging characteristics and spectral sensitivities) of the photoconductive toner and/or the photoconductive toner layer have not yet been sufficiently analyzed.

SUMMARY OF THE INVENTION

In order to form a distinct image a great difference between the initial surface potential in the charging step and the residual potential in the exposure step is required. For that purpose, first, a photoconductive toner layer must be uniformly and initimately formed on a substrate; secondly, the initial surface potential of the toner layer must be maintained at as high a level as possible, namely, an excellent charging characteristic must be created; and thirdly, the residual potential on the toner layer after the exposure treatment must be as low as possible, namely, enhancement of the spectral sensitivity must be effected.

The inventors of this invention have been doing research on the fundamental characteristics of the photoconductive toner, and have developed a novel method by which distinct images having remarkably reduced fog density can be formed.

The method of this invention which overcomes the above-discussed disadvantages and other numerous drawbacks and deficiencies of the prior art, comprises: (1) feeding a photoconductive toner, having an average particle diameter of 6 μm or less, to a conductive substrate to form a toner layer of 1 to 8 layers on said conductive substrate, (2) uniformly charging said toner layer, and (3) exposing said toner layer to form an electrostatic latent image thereon corresponding to the original.

The toner layer is, in a preferred embodiment, of a multiple toner layer of 2 to 4 layers.

The photoconductive toner consists, in a preferred embodiment, essentially of a charge-generating pigment and a resin binder.

The resin binder is, in a preferred embodiment, styrene-acrylic resin.

The charge-generating pigment is, in a preferred embodiment, a phthalocyanine pigment.

A bias potential having a different polarity from the charging polarity of said toner layer is, in a preferred embodiment, applied to said substrate.

Thus, the invention described herein makes possible the objects of (1) providing a method for the formation of images in which a photoconductive toner layer having excellent charging characteristics and spectral sensitivities is uniformly and intimately formed on a conductive substrate, resulting in a distinct image having a significantly reduced fog density; (2) providing a method for the formation of images in which a multiple photoconductive toner layer of 2 to 4 layers is formed on a conductive substrate and, moreover, styrene-acrylic resin is used as a resin binder constituting one of the elements of the photoconductive toner, thereby improving the charging characteristic and the spectral sensitivity of the toner so that a distinct image having remarkably reduced fog density can be obtained; and (3) providing a method for the formation of images by means of simplified processes in which a cleaning step is omitted.

BRIEF DESCRIPTION OF THE DRAWINGS

This invention may be better understood and its numerous objects and advantages will become apparent to those skilled in the art by reference to the accompanying drawings as follows:

FIGS. 2(*a*) and (*b*) are schematic illustrations of the adhesion models of toner particles to a conductive substrate according to this invention.

FIG. 3 is a graph showing the relationship between the number of toner layers and the initial surface potential, wherein the average particle diameter of each of the toners used is 5.2 μm, 7.2 μm and 8.6 μm.

DESCRIPTION OF THE PREFERRED EMBODIMENTS

The photoconductive toner used for this invention consists essentially of a charge-generating pigment and a resin binder. As the charge-generating pigment, any photoconductive pigment known to be useful for the photoconductive toners of this invention can be used, an example of which is a phthalocyanine pigment such as copper phthalocyanine, etc. As the resin binder, for example, styrene-acrylic resin can be used. Additives such as a sensitizing agent, a charge-control agent, a toner-blocking agent, etc., can be further used for the toner as desired.

The above-mentioned pigment and resin are mixed in a proper organic solvent in the proportion by weight of 1:3 to obtain uniform dispersion, and are subsequently subjected to a known spray drying process to form globular toner particles. In order to improve the resolution and the density of images, toner particles should have as small an average diameter as possible and the electrical charge should be kept as low as possible. However, insufficient particle diameter causes aggregation due to heat, ununiform development, scattering of the toner particles, etc. The toner in this invention has an average particle diameter of 6 μm or less, for example, 5.2 μm. These globular toner particles can be subjected to a surface finishing treatment as desired.

In order to compare the above-mentioned toner of this invention with reference standard toners, reference standard toners $A_1$ and $A_2$ having an average particle diameter of 7.2 μm and 8.6 μm, respectively, were prepared in the same manner as the toner of this invention. A further reference standard toner $B_1$, having an average particle diameter of 6.9 μm and using a polyester resin as a resin binder, was prepared in the same manner as the toner of the invention. The resin binder material and the average particle diameter of each of these toners are shown in Table 1.

TABLE 1

| Toner | Resin binder material | Average particle diameter (μm) |
|---|---|---|
| Toner of this invention | Styrene-acrylic resin | 5.2 |
| Reference standard toner $A_1$ | Styrene-acrylic resin | 7.2 |
| Reference standard toner $A_2$ | Styrene-acrylic resin | 8.6 |
| Reference standard toner $B_1$ | Polyester resin | 6.9 |

Figure 1A:
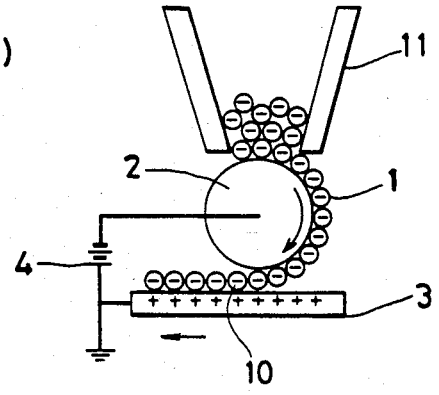
FIGS. 1(*a*) to (*c*) are a schematic illustration of a method of this invention.
Figure 1B:
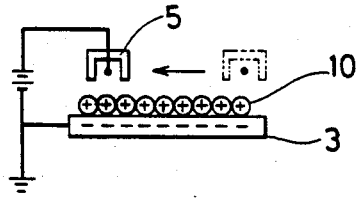
Figure 1C:
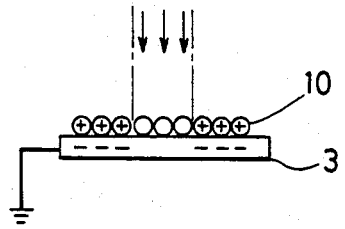

FIGS. 1(*a*) to (*c*) show the method for the formation of images of this invention which is carried out according to a xerographic process. As shown in FIG. 1(*a*), on the photoconductive toner 1 in a hopper 11, an electrostatic charge of, (e.g., a negative polarity) is induced by friction between the toner 1 and the wall of the hopper 11 and/or a magnetic carrier. The negatively charged toner 1 and the carrier adhere to a magnetic sleeve 2 disposed rotatably. At least the surface of the sleeve 2 is made of a conductive material. A bias potential 4 is applied between the sleeve 2 and a conductive substrate 3 made of aluminium, etc., in a manner that the substrate 3 is electrically charged with a different polarity (e.g., a positive polarity) from the charging polarity of the toner 1. The charged toner 1 is transferred to the substrate 3 as the sleeve 2 turns. The charged toner 1 on the sleeve 2 is uniformly fed to the surface of the substrate 3 by the electrostatic force of attraction. By controlling the bias potential 4 at a certain level, the toner 1 can form a multiple toner layer 10 with the number of layers in a range of from 1 to 8 layers. The adhesion of the toner 1 on the sleeve 2 to the substrate 3 is carried out in the same manner as in a developing process in a common electrophotographic method by a developing means using a dual component magnetic brush.

Figure 4:
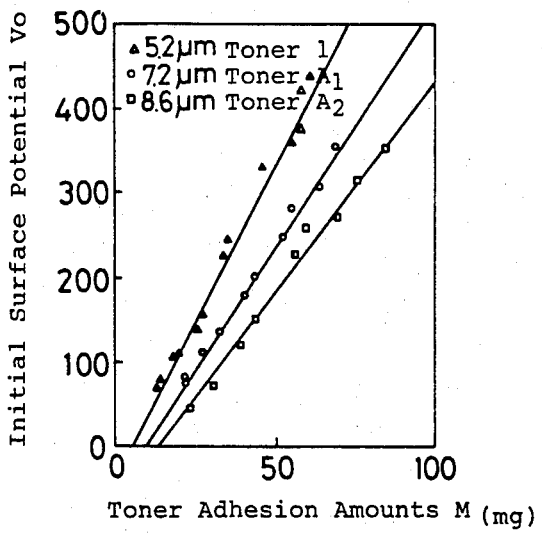
FIG. 4 is a graph showing the relationship between the amount of toner adhered to the substrate and the initial surface potential, wherein the average particle diameter of each of the toners used is 5.2 μm, 7.2 μm and 8.6 μm.
Figure 5:
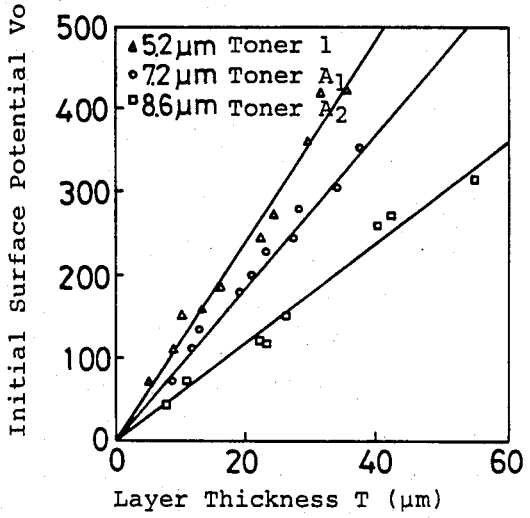
FIG. 5 is a graph showing the relationship between the thickness of the toner layer and the initial surface potential, wherein the average particle diameter of each of the toners used is 5.2 μm, 7.2 μm and 8.6 μm.

Then, the toner layer 10 on the substrate 3 is subjected to a charging treatment under an application potential of +5.6 KV using, for example, a corona charger 5 (FIG. 1(*b*)). The corona charging characteristic of the toner layer 10 is shown in FIGS. 3 to 5. The charging characteristic was analyzed by the measurement of the initial surface potential $V_0$ of the toner layer 10. It is assumed from microscopic observation that the toner 1 adheres to the substrate 3 in a sparse state illustrated in FIG. 2(*a*). On the other hand, the experimental data indicates that the adhesion rate of the toner 1 to the substrate 3 is in the range of 60 to 70% and, thus, the adhesion model of the toner 1 to the substrate 3 in the densest state (having an adhesion rate of approximately 74%) illustrated in FIG. 2(*b*) can be assumed. Therefore, analysis of the charging characteristic and the spectral sensitivity of the toner was carried uith based on the adhesion model in FIG. 2(*b*). Using this adhesion model, the relationship between the number N of toner layers and the initial surface potential $V_0$ was determined from the thickness of the toner layer 10 and the particle diameter on the average of the toner 1 and are shown in FIG. 3, which indicates that the initial surface potential $V_0$ depends upon the number N of toner layers, regardless of the particle diameter of the toner 1; namely, the amount of electric charges on the toner layer 10 depends upon the number N of the toner layers (i.e., the whole area of the toner 1 adhered to the substrate 3) and, moreover, the whole of the toner 1 is electrically charged by a charging treatment using the corona charger.

The application potential of +7.0 KV also gave the same results as the above-mentioned, except that the initial surface potential $V_0$ of the toner layer 10 was enhanced. The same results as the abovementioned were also obtained in the case where a polyester resin was used as a resin binder instead of styrene-acrylic resin. FIG. 4 shows the relationship between the initial surface potential $V_0$ and the adhesion amount of toner of the toner layer 10, and FIG. 5 shows the relationship between the initial surface potential $V_0$ and the thickness T of the toner layer 10, which indicates that the initial surface potential $V_0$ is proportional to the adhesion amount of toner and the thickness T, respectively. The proportionality constant depends upon the particle diameter of the toner.

Figure 6:
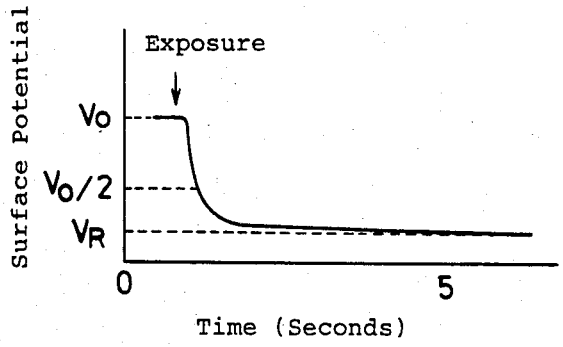
FIG. 6 is a graph showing the optical decay of the surface potential on the photoconductive toner layer of this invention.
Figure 7:
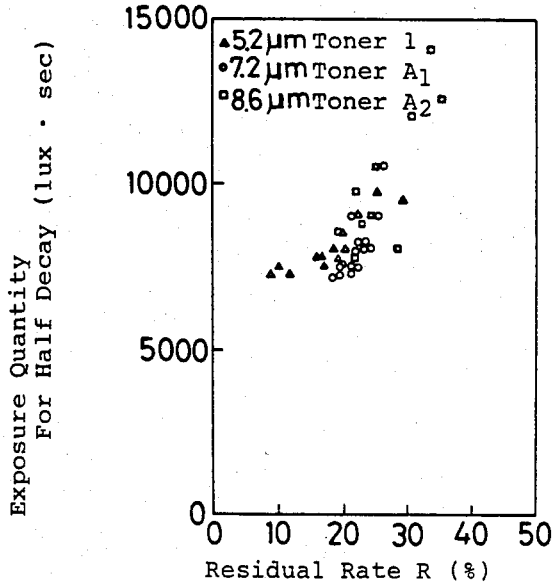
FIG. 7 is a graph showing the relationship between the residual rate of the surface potential and the spectral sensitivities (i.e., the exposure quantity for half decay of the potential) of the toner layer, wherein the average particle diameter of each of the toners used is 5.2 μm, 7.2 μm and 8.6 μm.
Figure 8:
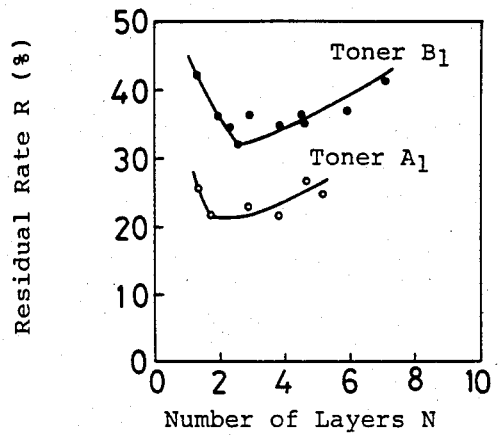
FIG. 8 is a graph showing the relationship between the number of toner layers and the residual rate of the surface potential thereon, wherein the average particle diameter of each of the toners used is 7.2 μm and 8.6 μm.
Figure 9:
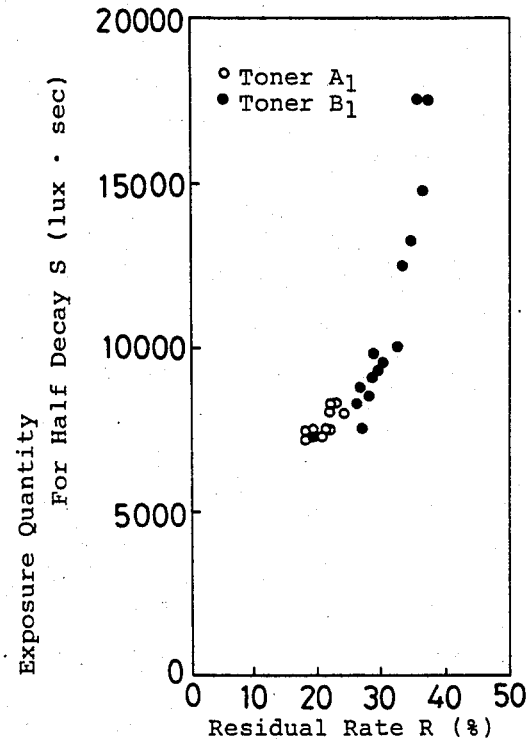
FIG. 9 is a graph showing the relationship between the residual rate of the surface potential and the spectral sensitivities of the toner layer, wherein the average particle diameter of each of the toners used is 7.2 μm and 8.6 μm.

Then, the uniformly charged toner layer 10 is subjected to an exposure treatment, using, for example, a white lamp having an exposure strength of 25,000 lux, to form an electrostatic latent image corresponding to the original (FIG. 1(*c*)). The exposured toner layer 10 is rendered photoconductive, and the surface potential thereof decays rapidly as shown in FIG. 6, wherein a reference $V_R$ is the surface potential at 5 seconds after exposure (i.e., the residual potential). The spectral sensitivity of the toner layer 10 at that exposure can be indicated by the initial surface potential $V_0$, the exposure quantity (lux second) S for half decay of the potential and the residual rate R as shown in FIGS. 7 to 9. The exposure quantity S, which is the exposure quantity required to be reduced to half-one of the initial surface potential $V_0$, can be represented by the product of the half-life period of the surface potential and the exposure strength. The residual rate R is represented by the percentage of the residual potential $V_R$ at 5 seconds after exposure to the initial surface potential $V_0$. FIG. 7 indicates that the toner 1 in the lower area of the exposure quantity S for half decay of the potential exhibits a residual rate R lower than the reference standard toners $A_1$ and $A_2$, which have a greater diameter than the toner 1. This means that the particle diameter of the toner must be 6 μm or less in order to attain an excellent spectral sensitivity even at the time when the exposure strength is less. The same result can be obtained when a polyester resin is used as a resin binder. FIG. 8 indicates that the residual rate R decreases, regardless of either the toner particle diameter or the kind of resin binder material, when the number N of toner layers is in the range of 1 to 8, especially 2 to 4. Thus, when the toner layer 10 is constructed of from 2 to 4 layers, the most excellent spectral sensitivity of the toner layer can be attained. FIG. 9 shows the dependence of the spectral sensitivities on the kind of resin binder material, which indicates that although the minimum value of the exposure quantity S for the half decay of the potential with respect to the reference standard toner $B_1$ using a polyester resin as a resin binder is approximately the same as that of the reference standard toner $A_1$ using a styrene-acrylic resin as a resin binder, the residual rate R of the toner $B_1$ is significantly high as a whole and, moreover, the exposure quantity S for the half decay of the potential of the toner $B_1$ increases rapidly as the residual rate R thereof increases. These facts indicate that the spectral sensitivities of toners remarkably depend upon the kind of resin binder material.

Then, on the toner layer 10 on the substrate 3 forming the electrostatic latent image thereon, a transfer paper is disposed in a manner to be come into contact with the toner layer 10 and is charged from behind with a different polarity (e.g., negative polarity) from the charging polarity of the toner layer 10 by means of a corona charger. The toner is transferred to the transfer paper and then fixed thereon by a proper fixing means, resulting in an extremely distinct image in which fog density is significantly suppressed. The substrate 3 is used for the next cycle for the formation of images, without cleaning the remaining toner layer thereon, so that the amounts of toner, which correspond to those consumed in the preceding cycle, are only required for the formation of toner layer on the substrate 3 in the succeeding step (FIG. 1(*a*)). Since the cleaning step can be omitted, the method for the formation of images according to this invention can be simplified.

It is understood that various other modifications will be apparent to and can be readily made by those skilled in the art without departing from the scope and spirit of the invention. Accordingly, it is not intended that the scope of the claims appended hereto be limited to the description as set forth herein, but rather that the claims be construed as encompassing all the features of patentable novelty which reside in the present invention, including all features which would be treated as equivalents thereof by those skilled in the art to which this invention pertains.

What is claimed is:

1. A method for the formation of images comprising:

(1) uniformly inducing an electrostatic charge on a photoconductive toner, having an average particle diameter of 6 μm or less, by friction between the toner and at least one of a wall of a hopper containing said toner therein and a magnetic carrier, (2) applying a bias potential having a different polarity from the charging polarity of said toner to a conductive substrate, (3) feeding said charged toner to said charged conductive substrate to uniformly and intimately form a toner layer of 1 to 8 layers on said conductive substrate, while controlling the bias potential at a certain level depending upon the amount of electrostatic charges on said toner, (4) uniformly charging said toner layer, and (5) exposing said toner layer to form an electrostatic latent image thereon corresponding to an original.

2. A method for the formation of images according to claim 1, wherein said toner layer is of a multiple toner layer of 2 to 4 layers.

3. A method for the formation of images according to claim 1, wherein said photoconductive toner consists essentially of a charge-generating pigment and a resin binder.

4. A method for the formation of images according to claim 3, wherein said resin binder is styrene-acrylic resin.

5. A method for the formation of images according to claim 3, wherein said charge-generating pigment is a phthalocyanine pigment.

6. A method for the formation of images according to claim 1, wherein a bias potential having a different polarity from the charging polarity of said toner layer is applied to said substrate.

7. A method according to claim 1, wherein said 1 to 8 layers are respectively approximately one toner particle deep.

* * * * *